United States Patent [19]

Spies

[11] 4,030,282

[45] June 21, 1977

[54] RESILIENT SUPPORT FOR SPINNING-RING OR TWISTING-RING BEARING

[75] Inventor: Alfons Spies, Munich, Germany

[73] Assignee: Dr. Johannes Heidenhain GmbH, Traunreut, Germany

[22] Filed: July 24, 1975

[21] Appl. No.: 598,790

[30] Foreign Application Priority Data

July 25, 1974 Germany ..... 2435771

[52] U.S. Cl. ..... 57/124; 308/26

[51] Int. Cl.[2] ..... D01H 7/56; D01H 7/64

[58] Field of Search ..... 57/122, 124; 308/15, 308/26

[56] References Cited

UNITED STATES PATENTS

| | | | |
|---|---|---|---|
| 1,165,012 | 12/1915 | Maloney | 57/122 |
| 2,454,707 | 11/1948 | Meyers et al. | 57/122 |
| 3,093,957 | 6/1963 | Tetreault | 57/122 |
| 3,611,697 | 10/1971 | Greb | 57/124 |

*Primary Examiner*—Richard C. Queisser
*Assistant Examiner*—Charles Gorenstein
*Attorney, Agent, or Firm*—Ernest F. Marmorek

[57] ABSTRACT

A bearing for a spinning or a twisting-ring as used in the textile industry. The bearing has a stator which is mounted on a spring loaded damper absorbing system which has different degrees of stiffness in two axes at right angles to each other. This is to hinder the development of "half-frequency" vibrations in the bearing.

6 Claims, 2 Drawing Figures

RESILIENT SUPPORT FOR SPINNING-RING OR TWISTING-RING BEARING

CROSS REFERENCE TO RELATED APPLICATIONS

Reference is made to the related co-pending applicatons Ser. No. 598,789 and Ser. No. 598,791, both by Alfons Spies and both filed on July 24, 1975, as was the present application.

BACKGROUND OF THE INVENTION

The invention concerns an air-bearing for a spinning or twisting-ring for use in the manufacture of textiles.

The object of the invention is to invent an air bearing for a spinning or twisting-ring of simple construction, which allows the highest possible r.p.m. without the bearing surfaces suffering any damage.

SUMMARY OF THE PRESENT INVENTION

The present invention provides an air bearing for a spinning or twisting-ring having a bearing stator mounted on a spring-loaded damping absorber-system which has different degrees of stiffness in two axes at right angles to each other. This process makes the development of "half frequency vibrations" difficult.

In a preferred embodiment of the invention, the bearing stator of the spinning or twisting-ring is mounted on two opposite ring segments floating in rubber, synthetic material or the like.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT AND OPERATION

Figure 1:
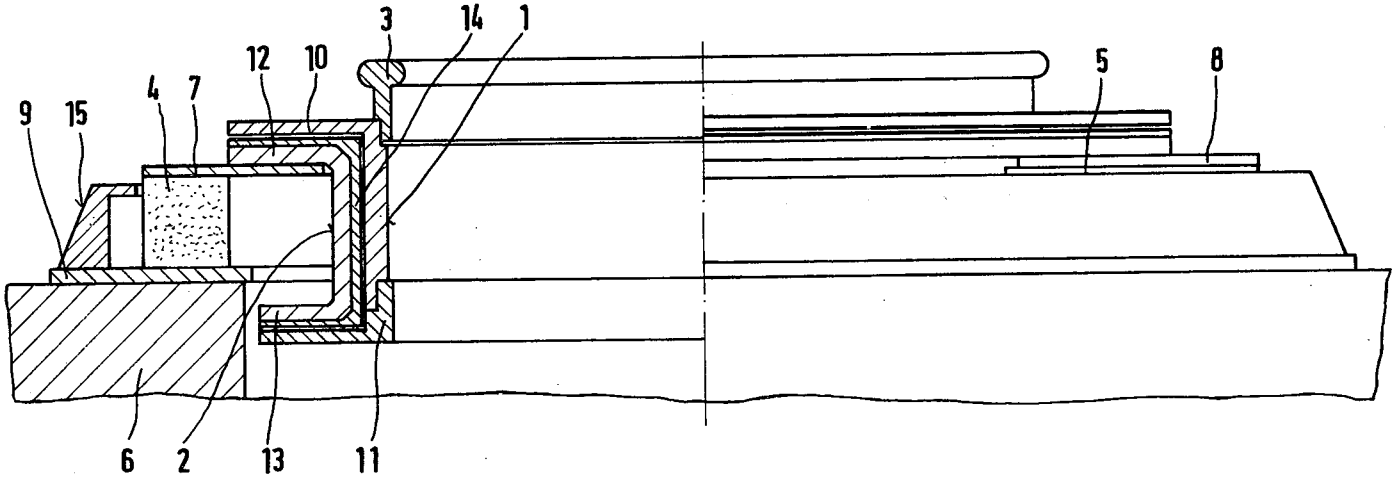
FIG. 1 is an elevational view, partially in section, of an air bearing according to the instant invention.
Figure 2:
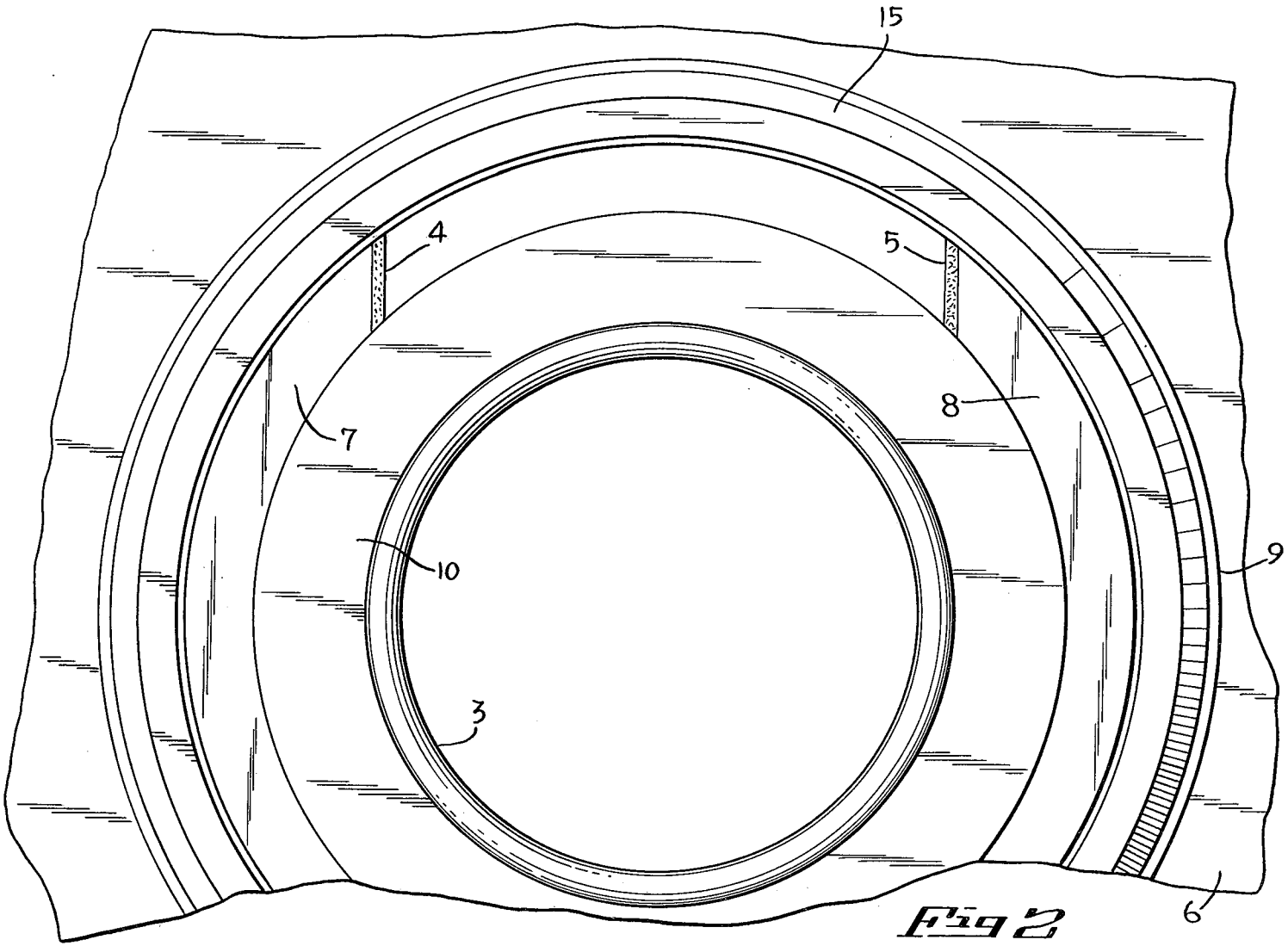
FIG. 2 is a fragmentary plan view of the air bearing shown in FIG. 1

In carrying the invention into effect in the embodiment which has been selected for illustration in the accompanying drawings and for description in the specification, and referring now particularly to the FIGS. 1 and 2.

A bearing for a ring 3 consists of a rotor 1 and a stator 2. The bearing stator 2 is mounted, floating in rubber, on a spinning-stand 6 by means of two ring segments 4 and 5, which lie diametrically opposite to each other. Through this design and arrangement of the ring segments 4 and 5, the absorber-system for the stator 2 has different degrees of stiffness in two axes at right angles to each other. This renders the production of "half frequency vibrations" difficult. In addition, the floating arrangement of the stator allows enlargement of the bearing space, so that manufacture is also simplified.

The ring segments 4 and 5 are mounted on the bearing stator 2 by means of fixing elements 7 and 8, and are secured to the spinning-stand 6 by means of a circular element 9. The bearing for the ring 3 is, in the example of embodiment an axial/radial air bearing. The bearing rotor 1 consists of the ring 3 and two outwardly directed flanges 10 and 11. The bearing stator 2 has annular flanges 12 and 13 which are opposite to and a small distance from the bearing surfaces of the rotor 1. The inner surfaces of the metallic stator 2 have a lining 14 of synthetic material with spiral grooves in it. A circular stop 15 surrounds the absorber-system 4/5 for the stator 2.

What is claimed is:

1. In an air bearing for a spinning or twisting ring and including a spinning stand, a stator, and a rotor, the improvement comprising an absorber-damper support system for resiliently supporting the stator on said stand, and including two oppositely disposed and spaced apart ring segments composed of resilient material, each said ring segment being disposed between and secured with relation to said stator and said stand thereby to support said stator with respect to said stand, with a resiliency which varies circumferentially around said support system.

2. In an air bearing, as claimed in claim 1, said absorber-damper system further comprising nonresilient securing elements operable to secure said resilient ring segments to said stator and to said spinning stand.

3. In an air bearing, as claimed in claim 1, wherein said ring segments are symmetrically disposed to provide said resiliency with different degrees of stiffness measured along two axes which are substantially perpendicular to each other.

4. In an air bearing, as claimed in claim 1, wherein said ring segments are composed of rubber.

5. In an air bearing as claimed in claim 1, wherein said ring segments are composed of a synthetic polymeric material.

6. A bearing according to claim 1 wherein the stator is a component of an axial/radial air bearing.

* * * * *